US011091872B1

(12) United States Patent
Somaya et al.

(10) Patent No.: US 11,091,872 B1
(45) Date of Patent: Aug. 17, 2021

(54) GARMENT CARE DEVICE

(71) Applicant: Unwrinkly, Inc., Brooklyn, NY (US)

(72) Inventors: Vishva Somaya, Brooklyn, NY (US); Naren Inukoti, Brooklyn, NY (US); Rahul Sheth, Brooklyn, NY (US)

(73) Assignee: Unwrinkly, Inc., New York, NY (US)

( * ) Notice: Subject to any disclaimer, the term of this patent is extended or adjusted under 35 U.S.C. 154(b) by 0 days.

(21) Appl. No.: 16/945,708

(22) Filed: Jul. 31, 2020

Related U.S. Application Data

(60) Provisional application No. 62/881,827, filed on Aug. 1, 2019.

(51) Int. Cl.

| | |
|---|---|
| ***D06F 58/20*** | (2006.01) |
| ***D06F 39/00*** | (2020.01) |
| ***D06F 39/02*** | (2006.01) |
| ***D06F 58/10*** | (2006.01) |
| ***D06F 95/00*** | (2006.01) |
| ***D06F 34/18*** | (2020.01) |
| ***D06F 34/20*** | (2020.01) |
| ***D06F 103/40*** | (2020.01) |
| ***D06F 103/02*** | (2020.01) |
| ***D06F 103/62*** | (2020.01) |
| ***D06F 105/44*** | (2020.01) |
| ***D06F 103/06*** | (2020.01) |
| ***D06F 105/62*** | (2020.01) |

(52) U.S. Cl.
CPC ..... *D06F 58/203* (2013.01); *D06F 34/18* (2020.02); *D06F 34/20* (2020.02); *D06F 39/008* (2013.01); *D06F 39/02* (2013.01); *D06F 58/10* (2013.01); *D06F 95/006* (2013.01); *D06F 2103/02* (2020.02); *D06F 2103/06* (2020.02); *D06F 2103/40* (2020.02); *D06F 2103/62* (2020.02); *D06F 2105/44* (2020.02); *D06F 2105/62* (2020.02)

(58) Field of Classification Search
CPC ..... D06F 58/10; D06F 58/14; D06F 58/203
See application file for complete search history.

(56) References Cited

U.S. PATENT DOCUMENTS

2008/0256989 A1* 10/2008 Jeong ..... D06F 73/02 68/5 C
2012/0047662 A1* 3/2012 Koch ..... D06F 58/203 8/137
2017/0268156 A1* 9/2017 Dana ..... D06F 58/203
(Continued)

FOREIGN PATENT DOCUMENTS

CN 108252069 A * 7/2018

OTHER PUBLICATIONS

CN108252069A Machine Translation (Year: 2018).*

*Primary Examiner* — Spencer E. Bell
(74) *Attorney, Agent, or Firm* — Perkins Coie LLP; Colin Fowler

(57) ABSTRACT

The present disclosure relates to a garment care device. The garment care device may include a housing and a garment bag. The garment bag can be disposed around a frame and attached to the housing. The garment bag can receive air along a first air flow from the housing and a mixture of steam and a chemical in a second air flow from the housing during a freshening process. A safety puck can engage to a fastener allowing for opening and secure closure of the garment bag and magnetically engage to an interface.

15 Claims, 12 Drawing Sheets

(56) References Cited

U.S. PATENT DOCUMENTS

| | | | | |
|---|---|---|---|---|
| 2019/0194856 | A1* | 6/2019 | Mukundala | G06Q 10/02 |
| 2020/0362505 | A1* | 11/2020 | Razouki | D06F 58/203 |
| 2021/0032797 | A1* | 2/2021 | Shin | D06F 67/005 |

* cited by examiner

GARMENT CARE DEVICE

CROSS-REFERENCE TO RELATED APPLICATION

The present application claims priority to U.S. Provisional Application No. 62/881,827, titled "COLLAPSIBLE GARMENT CARE DEVICE," and filed Aug. 1, 2019, which is incorporated by reference by its entirety herein.

TECHNICAL FIELD

The present disclosure relates to a garment care device, and, in particular, to a device to freshen garments by subjecting the garment to steam including a mixture of water and a chemical solution.

BACKGROUND

Articles of clothing are cleaned or maintained in various ways. Example methods for cleaning clothing can include utilizing irons, clothing steamers, in-unit washing and drying machines, laundromats, dry cleaners, and on-demand laundry services. Irons and garment steamers may be manually operated, where the user must be present through the process, and these devices solely focus on removing wrinkles. In-unit washer and dryers may include less user operation but can be an inefficient technique for cleaning only a few garments. Further, washers and dryers also take a large amount of time to complete cycles and are also not safe for all types of clothing.

Further, some fabrics (e.g., silk, wool, linen) may be more susceptible to damage or shrinking under normal use with washers and dryers. Both laundromats and dry-cleaners may be less accessible as other options, as a user must find a suitable option and travel there with the articles they wish to be washed, and dry cleaners may include a turn-around times requiring the user to drop their articles off and must return at a later time for pick-up. On-demand laundry services may provide a more accessible technique to clean garments, but they may only be available in specific regions and may include a turn-around time preventing the user from receiving clean clothes the same day they are picked up.

BRIEF DESCRIPTION OF THE DRAWINGS

Various features and characteristics of the technology will become more apparent to those skilled in the art from a study of the Detailed Description in conjunction with the drawings. Embodiments of the technology are illustrated by way of example and not limitation in the drawings, in which like references may indicate similar elements.

Figure 1:
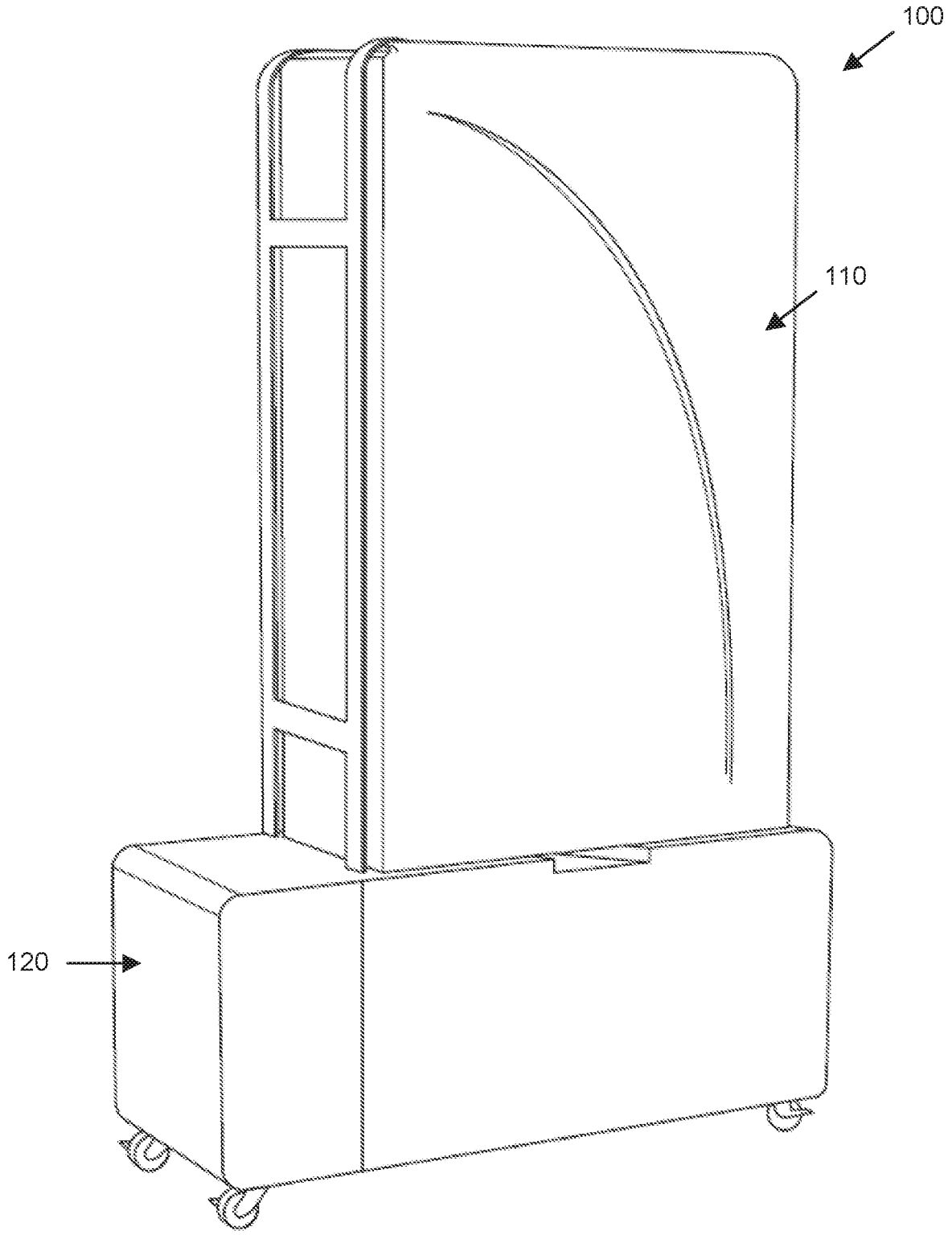
FIG. 1 is a perspective view of an example garment care device.

The drawings depict various embodiments for the purpose of illustration only. Those skilled in the art will recognize that alternative embodiments may be employed without departing from the principles of the technology. Accordingly, while specific embodiments are shown in the drawings, the technology is amenable to various modifications.

DETAILED DESCRIPTION

The embodiments set forth below represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. These concepts and applications fall within the scope of the disclosure and the accompanying claims.

Embodiments may be described with reference to particular computer programs, system configurations, networks, etc. However, those skilled in the art will recognize that these features are equally applicable to other computer program types, system configurations, network types, etc. For example, although the term "Wi-Fi network" may be used to describe a network, the relevant embodiment could be deployed in another type of network.

Moreover, the disclosed technology can be embodied using special-purpose hardware (e.g., circuitry), programmable circuitry appropriately programmed with software and/or firmware, or a combination of special-purpose hardware and programmable circuitry. Accordingly, embodiments may include a machine-readable medium having instructions that may be used to program a computing device (e.g., a base station or a network-connected computer server) to examine video content generated by an electronic device, identify elements included in the video content, apply a classification model to determine an appropriate action, and perform the appropriate action.

Terminology

The purpose of terminology used herein is only for describing embodiments and is not intended to limit the scope of the disclosure. Where context permits, words using the singular or plural form may also include the plural or singular form, respectively.

As used herein, unless specifically stated otherwise, terms such as "processing," "computing," "calculating," "determining," "displaying," "generating," or the like, refer to actions and processes of a computer or similar electronic computing device that manipulates and transforms data represented as physical (electronic) quantities within the computer's memory or registers into other data similarly represented as physical quantities within the computer's memory, registers, or other such storage medium, transmission, or display devices.

As used herein, terms such as "connected," "coupled," or the like, may refer to any connection or coupling, either direct or indirect, between two or more elements. The coupling or connection between the elements can be physical, logical, or a combination thereof.

References to "an embodiment" or "one embodiment" means that the particular feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the words "comprise" and "comprising" are to be construed in an inclusive sense rather than an exclusive or exhaustive sense (i.e., in the sense of "including but not limited to").

The term "based on" is also to be construed in an inclusive sense rather than an exclusive or exhaustive sense. Thus, unless otherwise noted, the term "based on" is intended to mean "based at least in part on."

When used in reference to a list of multiple items, the word "or" is intended to cover all of the following interpretations: any of the items in the list, all of the items in the list, and any combination of items in the list.

The sequences of steps performed in any of the processes described herein are exemplary. However, unless contrary to physical possibility, the steps may be performed in various sequences and combinations. For example, steps could be added to, or removed from, the processes described herein. Similarly, steps could be replaced or reordered. Thus, descriptions of any processes are intended to be open-ended.

System Overview

The present embodiments relate to a smart automatic garment care device. The garment care device can freshen garments (or clothing) by removing wrinkles, odors, and bacteria from clothing. Garments may be placed and closed within a garment bag, and the garment bag may be filled with steam. The steam may include a mixture of water and a chemical solution. Garments may be freshened using a multi-phase cycle that can include any of: preheat, steam, condense, and dry.

Inside the garment bag during the preheat cycle, the temperature may increase. The preheat cycle may utilize a blower and a resistance wire heating element to circulate hot air around the garment bag.

The steam cycle may increase the temperature while also increasing the relative humidity inside the garment bag. The steam cycle may heat and/or mist a mixture of water and chemical solution into steam and fills the garment bag. The steam cycle can heat the water and provide steam in the garment bag. The chemical can be provided (e.g., misted directly into the steam, mixed into the water that is then heated to turn into steam) into the garment bag via various methods (e.g., misted directly into the steam, mixed into the water that is then heated to turn into steam, misting the chemical directly onto the clothing when the cycle is being performing using one or more nozzles). The distribution of the water and chemical solution throughout the garment bag can ensure an even spread of steam on the clothing.

The condense part of the multi-phase cycle can utilize a blower to circulate the steam through a condensation trap. The condensation trap can include a serpentine path underneath the water tank. The water tank may be made of a rigid material (e.g., stainless steel) to easily allow for the transfer of heat from the steam to condense the steam. Condensed steam then can travel through openings in the serpentine structure into a grey water collection tank. The air after the serpentine structure can then be re-introduced into the garment bag. The dry part of the cycle may lower the humidity. The dry cycle may utilize the blower and a resistance wire heater to circulate hot air through the garment bag.

In some instances, the condense part of the multi-phase cycle can include passive cooling. In other instances, the condense part of the multi-phase cycle can include an active cooling method, such as by incorporating a fan, for example.

In a first embodiment, a garment care device can include a housing. The device can also include a frame assembly removably engaged to the housing. The device can also include a garment bag disposed around the frame assembly and removably engaged to the housing. The garment bag can be configured to receive and enclose a garment. The garment bag can also be configured to receive air along a first air flow from the housing and a mixture of steam and a chemical in a second air flow from the housing. The device can include a safety puck configured to engage to a fastener allowing for opening and secure closure of the garment bag and magnetically engage to an interface. The device can also include a processing unit configured to control components of the garment care device and initiate a freshening cycle responsive to determining that the safety puck is magnetically engaged to the interface.

In some embodiments, the housing can include any of a tank capable of holding an amount of water, a boiler configured to heat a portion of the amount of water into steam in the first air flow, a chemical nozzle configured to disperse the chemical into the first air flow, and a blower configured to direct air along the second air flow.

In some embodiments, the freshening process includes any of: a heating process, a steam process, a condensation process, and a dry process.

In some embodiments, the processing unit is further configured to detect a garment type, fabric type, and/or a wrinkle severity of the garment disposed in the garment bag and identify a recommended freshening cycle type based on the garment type, wherein the initiated freshening cycle includes the recommended freshening cycle type.

In some embodiments, the device includes a secondary reservoir disposed between the tank and boiler. The secondary reservoir can feed water into the boiler responsive to the processing unit detecting that a boiler sensor indicates that a water level in the boiler is below a threshold level.

In some embodiments, the device includes a tensioner apparatus including set of extendable tension cables and a set of clips configured to engage to the garment and provide tension to the garment disposed in the garment bag.

In some embodiments, the processing unit is further configured to receive identification information via a touchscreen disposed on the garment care device, process the identification information to verify an identity of a client. Responsive to verifying the identity of the client, the processing unit can unlock a locking mechanism disposed on the garment bag to allow for retrieval of the garment from the garment bag.

In an embodiment, a method for performing a garment freshening process using a garment care device is disclosed. The method can include engaging a frame assembly to a housing. The method can also include engaging a garment bag over the frame assembly and to the housing.

The method can also include determining that the garment bag is closed by detecting that a fastener disposed along the garment bag that allows for opening and secure closure of the garment bag is in an enclosed position based on a safety puck engaged to the fastener being magnetically engaged to an interface. The method can also include, responsive to determining that the garment bag is closed, initiating a multi-stage freshening cycle that includes directing a mixture of an amount of steam and an amount of a chemical in a first air flow and directing heated air along a second air flow via a plenum between the housing and the garment bag.

In some embodiments, the method includes detecting a garment type and a fabric type of the garment disposed in the garment bag and identifying a recommended freshening cycle type based on the garment type, wherein the freshening cycle includes the recommended freshening cycle type. Detecting the garment type and/or a fabric type can be performed automatically based on processing sensor data or obtaining an indication from a user via a client device or via the interface, for example. The recommended cycle can be identified based on both the garment type and the fabric type. Factors that can be modified based on the garment type/fabric type can include, for example, steam level, steam type, garment bag heat, time for each cycle type, etc. In some instances, based on a level of severity of wrinkles (e.g., either automatically determined or indicated by the user), features of the freshening cycle can be modified, such as a length and volume of steam in the garment bag, a time of heating, etc.

In some embodiments, the method includes engaging a set of clips of a tensioner apparatus to the garment disposed in the garment bag, wherein the tensioner apparatus includes a set of extendable tension cables engaged to the housing and the set of clips to provide tension to the garment.

In some embodiments, the method includes stopping the freshening cycle responsive to detecting that the safety puck has magnetically disengaged from the interface.

FIG. 1 is a perspective view of an example garment care device 100. As shown in FIG. 1, the garment care device 100 may include a garment bag 110 and a housing 120.

The device 100 may be oriented in an upright state and may include the garment bag 110 with an enclosed space and a surrounding housing 120 or body which can hold various components of the device. The bag 110 and housing 120 can be connected via detachable connection points around the exterior of the garment bag, and two plenums that can attach to the bottom of the garment bag, creating an air and steam path. Particularly, multiple (e.g., two or more) plenums can create an air path to direct air, steam, and/or chemicals.

While two plenums may be used as an illustrative example, any suitable number of plenums directing air/steam/chemicals to/from the housing and the garment bag.

The garment bag 110 may include various components, including a fabric, a fabric coating, a zipper, a thread, and a supporting structure. The fabric may comprise a durable and heat resistant fabric, such as polyester or nylon, for example. Fabric structure may include canvas or ripstop, for example. The fabric may include a water and temperature resistant coating, such as thermoplastic polyurethane (TPU), for example.

The fabric and coating combination may include a maximum operating temperature of at least 120 Celsius, for example. Any of the other components used in the garment bag may also have a minimum temperature rating of between 60 and 140 degrees Celsius, for example.

In the enclosed space, articles meant to be freshened may hang inside on a crossbar via provided hangars. These articles can be many different types of objects which are made up of fabric-like material including but not limited to garments of clothing, shoes, and bedding. The enclosed space may include a rectangular space surrounded by the garment bag on all sides.

In some embodiments, the enclosed space may include a crossbar which can be used to hold the hangars on which the fabrics are hung. This crossbar can be made from a variety of materials, which may be highly temperature resistant with a minimum operating temperature of 120 Celsius. The crossbar may also be able to withstand a force being applied and removed to mirror the effects of articles being hung and removed. The crossbar can withstand a minimum hanging load of 20 pounds, for example. One cycle may be counted as hanging and removing a hangar with an article hung on it from the crossbar.

The crossbar may also include multiple (e.g., 3) notches or ridges which may create an area for two hangars to sit without falling off. When a hangar is inserted onto the crossbar, it may fall into the groove or notch setting it in place, which may help the user know the article and hangar are in the correct position. By hanging the clothes in this method, gravity is used to keep the fabric in tension.

In some embodiments, the garment bag may include one or more clips on the bottom of the garment bag. The clips may attach to a garment in the garment bag and provide tension to the garment. The clips may include an elastic material to provide varying levels of tension to garments. The clips can be attached to a retracting device that can use a high-durability cord and a spring enclosed in a housing.

In some embodiments, the garment bag 110 may include two plenums on the bottom side and a door on the front of the garment bag. Plenums may refer to openings in the garment bag connecting the air and steam passageways from inside the body of the device to allow for the steam and air to flow through the garment bag and come in contact with the fabrics which are hanging inside.

A door may be made by using a zipper stitched into the front of the garment bag. The zipper may include water-resistant properties to prevent oxidation and may be flexible to maintain a curved "C" shape design on the garment bag. The curved design may allow for easy entry into the enclosed space and a viewing angle of the crossbar allowing for easy insertion and removal of fabrics on hangars. A zipper pull may help the user to unzip the bag easily. Sensors (e.g., a magnetic "puck") may be engaged to the zipper and to ensure closure of the bag before, during, and after the cleaning process as a safety feature.

Various stitching techniques may be to create folding lines. The rigid material may be made into rectangular shapes and stitched into the garment bag at different heights as a type of "ribbing" to provide support around the garment bag maintaining the shape of the enclosed space. The removable attachment points may also create a modular design for the garment bag and the housing of the product allowing the garment bag to be removed and replaced when damaged without any disassembly of the housing itself. Example removable attachments points can include, but are not limited to, screws, wing nuts, snap connection, and twist locks. These types of connections may provide a way to keep the garment bag attached to the body of the device but also are capable of being removed when needed. These attachments use either twisting locks or friction to maintain the connection to the body and prevent accidental unattachment during normal use.

The housing 120 may include a front panel that can be removed and/or replaced. The front panel can be changed out for any color or material, such as textured plastics, colored fabric, or wood grain, for example.

Figure 2:
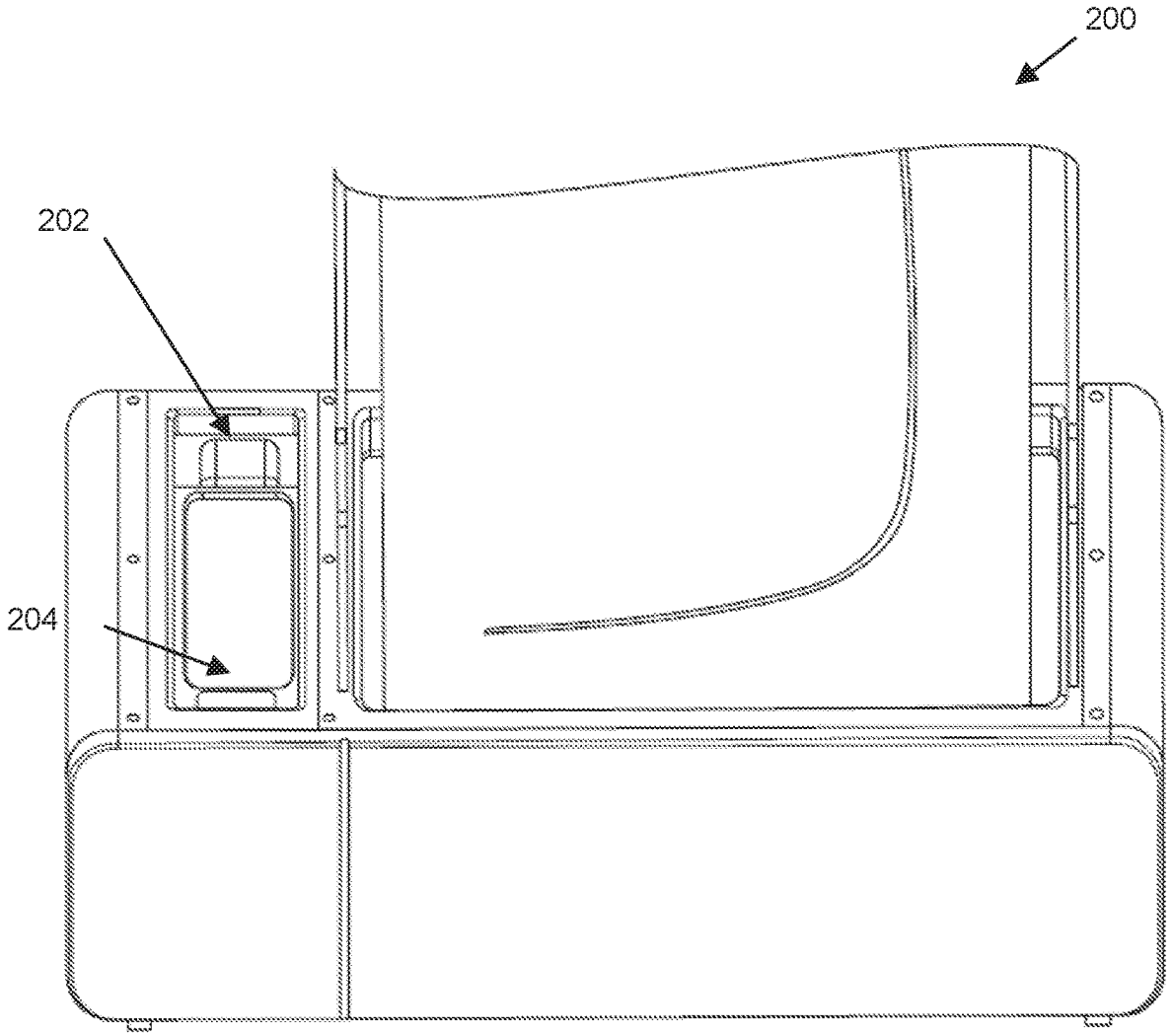
FIG. 2 is an illustration of an example housing including a chemical introduction area and a water tank.

FIG. 2 is an illustration of an example housing 200 including a chemical introduction area 202 and a water tank 204. The housing 200 may include a chemical introduction area 202 where chemicals can be introduced into the housing 200. For instance, a chemical bottle may introduce chemicals into the water tank 204 via chemical introduction area 202. As another example, the chemicals can be misted directly into the garment bag, mixed with the steam, mixed with water in a secondary reservoir/tank, etc.

The water tank 204 can hold 1.7 gallons, for example, and can be changed, of potable water. Above the water tank may include the chemical introduction area where the chemical bottle is inserted. The water tank 204 can include a sensor which is used to see if the water tank 204 is low. A computing device can provide a notification to the interface and can email staff to notify them that the water tank is to be refilled. There can be sensors added to measure the exact water level as well. The chemical system also can include a sensor that detects whether the device is running low on chemical solution and can push the same type of notification as the water tank sensor. A sensor can also detect if a chemical bottle or other chemical dispenser is present.

Figure 3:
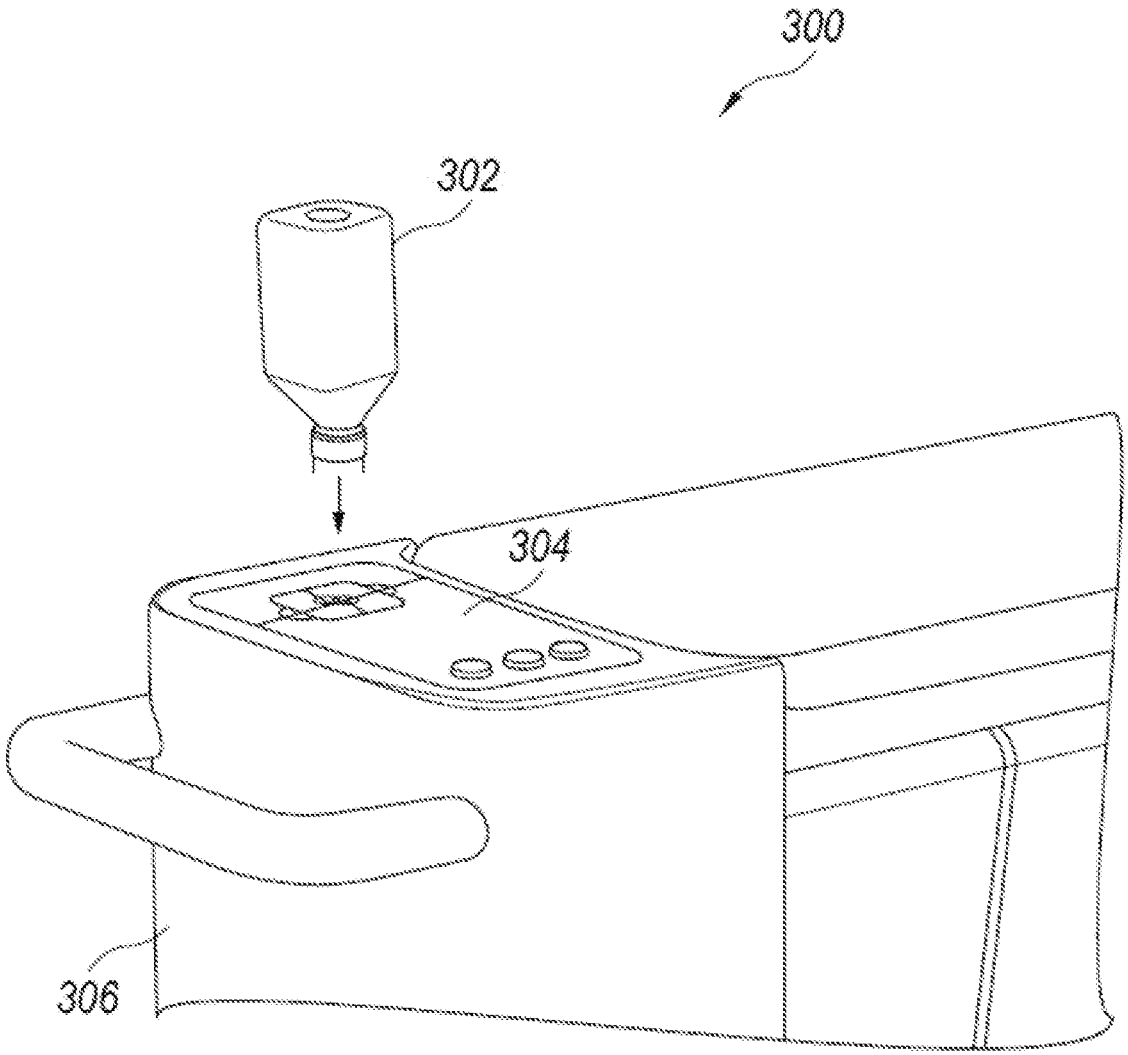
FIG. 3 illustrates a perspective view of an example garment care device interacting with a chemical bottle.

FIG. 3 illustrates a perspective view of an example garment care device 300 interacting with a chemical bottle 302. A cycle can be run with or without a chemical solution. The embodiment in FIG. 3 shows the chemical bottle interacting with the device 300.

The chemical solution may be introduced to the system in liquid form via a bottle 302. The bottle and bottle holder can be made into various shapes and sizes but can match each other to allow for proper fitting and prevent non-provided bottles from being used. The bottle may be made with a physical Digital Rights Management, DRM, to prevent unauthorized chemical solutions being used with the device. Physical DRM can include but is not limited to bottle shape, a physical notch on the bottle, QR code on the bottle that is scanned upon insertion, or RFID tag and reader. These methods can ensure the provided chemical solution is being used.

The chemicals may be sprayed into the path of the steam and the steam carries the chemical with it onto the clothing. In some instances, the chemicals may be sprayed onto the clothing or introduced in the boiler. The chemical can be sprayed into the steam by a peristaltic pump and a fine misting nozzle.

In some embodiments, the chemical solution may be applied to garments inside the garment bag by one or more spraying mechanisms disposed inside the garment bag. One or more spraying mechanisms can be disposed in any part of the garment bag and configured to spray any of water and/or the chemical solution onto garments in the garment bag. The chemical solution may be sprayed onto the clothing at the end of the preheat part of the cycle. As the chemical is sprayed onto the clothing, the water may be introduced into the boiler. Once the chemical spray is complete, the pump may turn-off and the boiler may start to heat the water creating steam. In some instances, the chemical can be added to a secondary reservoir with water and then boiled with water into a steamed mixture of the steam and the steamed chemical.

In some embodiments, the device can include a space that includes an accessible area on the device where the bottle can be inserted for use. The insertion space for the bottle can be in a variety of areas of the device, such as, next to a removable water tank or on the top surface near the user interface. The bottle may include a plastic cap that uses a leak proof silicone septum to keep the solution from leaking when turned upside down. The chemical may only flow from the bottle when the septum is pierced. When the bottle is inserted into the device, a physical notch on the bottle may activate a mechanical button in the bottle holder. This button actuates a hypodermic needle to be pushed through the septum into the bottle. A hypodermic needle is a hollow needle used for piercing and allowing the liquid to flow through it. This needle may be connected to the chemical pump allowing for the solution to be metered into the system where it can flow into the secondary mixing chamber with water. The silicone septum may be self-sealing, meaning when the hypodermic needle is removed, the silicone septum may still remain leak proof. The formulation itself may be used to improve the effectiveness of the steam in removing wrinkles, odors, and bacteria from the articles. The chemical solution may include a fiber relaxer that loosens the fibers of the clothing making the steam more effective in removing wrinkles, an anti-microbial that aids in the removal of bacteria, and a scent that is added onto the articles.

In some embodiments, the bottle can be a square bottle. The cap can be a plastic plunger style cap that prevents the flow of chemical until the plunger is activated. The plunger may be activated when it is pushed down. When the bottle is turned upside down and inserted into the device, there may be a physical feature that pushed onto the plunger allowing for the chemical to flow. From there, a peristaltic pump can meter the chemical when needed. The device may also include a sensor to detect whether a bottle is inserted, and a level sensor can indicate when the chemical is low. Any cap as described herein can be used to mist chemicals directly into the garment bag or mix the chemical with water or steam as described herein.

Figure 4A:
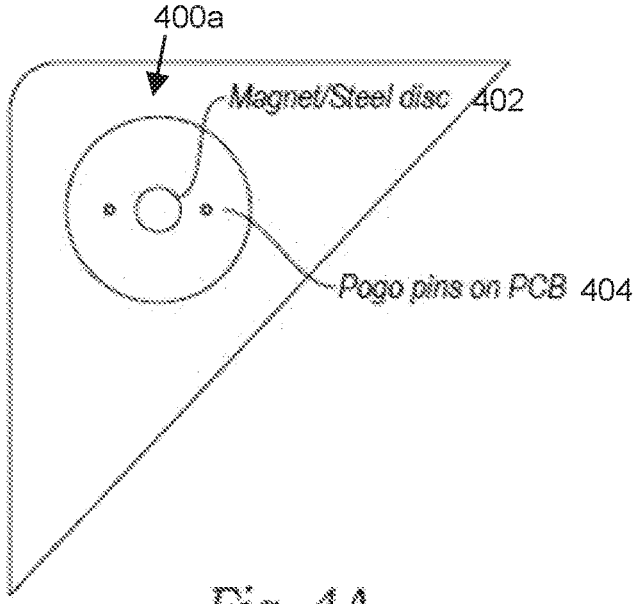
FIG. 4A is a perspective view of an outer portion of the safety puck.
Figure 4B:
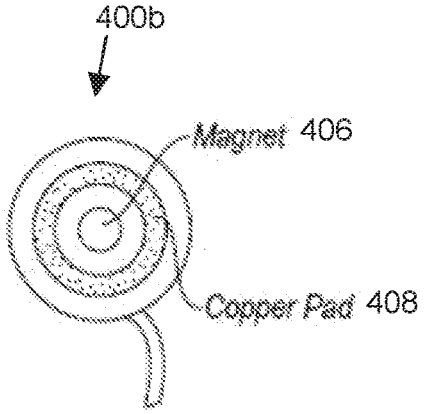
FIG. 4B is a perspective view of an inner portion of the safety puck.
Figure 4C:
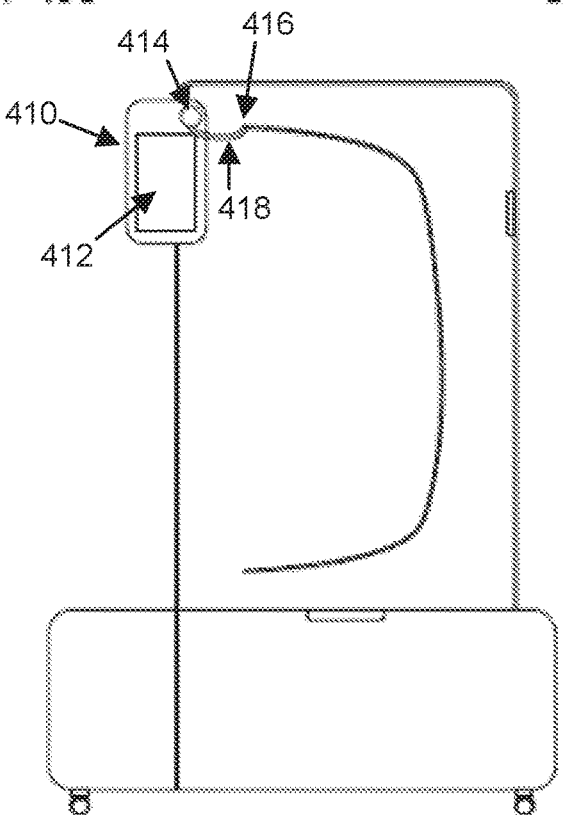
FIG. 4C is a perspective view of a safety puck engaged to an interface and a zipper.

FIGS. 4A-4C illustrate various perspectives of a safety puck 402. The safety puck can be used to prevent the device from starting while the garment bag is still open and to shut the device down if the garment bag is opened during a cycle. The safety puck can work by closing a circuit on the input panel, as when the pucks face, a metallic (e.g., copper) ring, comes in contact with its base the circuit is closed, it can send a signal to the device that the zipper is closed. The safety puck can include a magnet on the base and in the puck which allows the puck to fit into place when connected. The puck can also attach to the zipper of the bag at a length where if the zipper is opened the puck will be removed from the magnetic base, the circuit can be opened and the device can be turned off.

FIG. 4A is a perspective view 400*a* of an outer portion of the safety puck 402. The safety puck can include a magnet and a metallic disc. The magnet can be disposed within a metallic (e.g., steel) disc. The outer portion of the safety puck can removably engage with a zipper disposed on the garment bag, for example. The outer portion of the safety puck can also include one or more pins to electrically connect to a circuit board (e.g., printable circuit board (PCB)).

FIG. 4B is a perspective view 400*b* of an inner portion of the safety puck 402. The safety puck can include a magnet and a copper pad surrounding the magnet. The copper pad can removably engage with a portion of an interface, which is shown in FIG. 4C, for example.

FIG. 4C is a perspective view 400*c* of a safety puck 402 engaged to an interface 404 and a zipper 406. The safety puck 402 can engage with a zipper such that, responsive to a threshold amount of pressure applied to the zipper, the safety puck 402 is removed from the interface 404. In such an event, the safety puck 402 can open a circuit formed between the safety puck 402 and interface 404, which can stop any freshening process performed by the device.

The safety puck includes a magnet allowing for engagement with pins on a PCB of the interface. When the puck is engaged to the interface, a circuit can be closed, indicating that the fastener (e.g., zipper) of the garment bag is secured.

The interface can include a touchscreen interface that allows for display and interaction with a client to perform various actions, such as to initiate a garment freshening cycle, for example. The interface can identify a garment type, fabric type, and/or a wrinkle severity of the garment in the garment bag and decide an appropriate cycle type for the garment. The touchscreen can be made from but not limited to an LCD or liquid crystal display and can be controlled by touch or physical buttons next to the screen.

In some embodiments, the device may also include a payment system on the user interface to be used as a self-service machine. This payment system can be but is not limited to a credit or debit card swipe reader or a contactless system like radio frequency identification RFID or near field communication NFC. This self-service system can be used in a business establishment or public spaces where multiple users have access to the device. This system can allow for each user to pay a set fee per cycle and use the device. Once the user uses the integrated payment system to make a payment for a cycle, the unit may be activated, and the user will be able to insert their clothing into the device and start a cycle. Another self-service model can be made without an integrated payment system on the device. This model can work by the user approaching the device that is placed in a public location, on the device itself would be a QR code that can be scanned or website URL that would guide the user to a mobile web address. Each device may have a particular code associated with it, through the mobile website the user can select the exact unit that they will be using. Once that particular unit is chosen, the user may be able to activate the unit by paying for a cycle. Once the cycle is paid for, the unit may be activated, and the user is able to insert their articles into the device then pick and start a cycle.

In some instances, the device may include a QR code or URL for a user to access a web address through a notification to a user device when they input client information into an interface. The user can also add a pre-paying cycle and/or a subscription to use the device through the web address.

In some embodiments, a user, via a user device or the interface, can select a freshening cycle type and perform other actions, such as make a payment for use of the device. For instance, a user via a mobile device can wirelessly access a webpage associated with the device and purchase access to the device for a freshening cycle on the webpage.

In some embodiments, a cycle may be selected from the interface on the top of the device. The cycle selection can be done using selector buttons, toggle switches, or a rotating knob. Light indicators can notify the user of which cycle has been chosen. Starting the cycle may be dependent on the type of interface for cycle selection if buttons or a toggle switch are used there will be a separate start cycle button if the rotating knob is used the knob can be used as a start cycle button as well by pushing down on it.

With communication modules added, the device may be a smart device. The device may be controlled by a mobile device with wireless communication capabilities and collect data from the device. To use the device through a mobile device, the user may be able to connect to the device using a suitable wireless connection (e.g., Wi-Fi, Bluetooth®, or a wireless cellular communication protocol). Once connected, the user may be able to use a mobile application to control the device, receive notifications, and receive data.

By controlling the device from a mobile device, the user may be able to select the cycle, start or stop the cycle, or schedule cycles. Scheduling cycles may mean the user is able to insert their articles into the device beforehand and from the mobile application choose for the cycle to be started at a later time or date. The data received by the user on the mobile application may include how much time is left on a running cycle, how much water is left in the water tank, and how much chemical solution is left in the bottle. The user may also be able to receive alerts for various aspects of the device. The alerts can be customized and can include notifications when the cycle is complete, the water level is running low, the chemical solution is running low, when the device is in use or available, etc. The user also can identify whether a device is free/available or in use via a user device or via the interface.

Because the device is a smart device with the communication modules, data can also be collected on the uses of the device. This data may include the number of cycles run, types of cycles run, and when a cycle is run. Using this data, the user may be able to see an estimation of a price, time, water, and electricity saved compared to other methods of clothing care including dry cleaning, laundry, or ironing.

Safety features may be used throughout the device to prevent injuries to the user or unintended usage of the device. The device may have an auto shut-off function when a cycle is on and the device is tipped over. This shut-off may prevent the water in the boiler from continuing to be heated and leak when tipped over. There may be two temperature restricting safety measures in place on the boiler. The first temperature sensor used may include a thermostat set to a temperature of a threshold temperature, such as a temperature between 100° C. and 150° C., for example. When the boiler reaches a temperature above this limit the heating element is turned off but can turn on again when the temperature is reduced below the level. If the thermostat is disconnected, the fuse may be used as a secondary temperature sensor. The thermal fuse may allow for the boiler to continue operating until a current of 10 Amps and up to 192° C. degrees, for example. When this current temperature is reached, the fuse may break permanently, preventing the boiler from turning on.

There also may be temperature sensor by the air heating element that turns off the heating elements when it detects the temperature to be greater than 150° C. This can allow for the heater to turn off and on to prevent it from going over that temperature.

The device may include water level sensors for any of the water tank, a secondary reservoir, and/or the grey water tank. The sensor for the water tank may be used to determine when the water level is too low and must be filled before running another cycle. The sensor for the grey water tank may be used for when the grey water tank is at or reaching its maximum capacity and must be emptied before starting another cycle. The interface on the device may also notify the user when there are errors and the cycle cannot be started. This can be done with a light indicator on the device near the cycle selection interface accompanied with a light for where the error is from. A sensor in the secondary reservoir can be used to provide enough water to the boiler for the specific cycle running.

In some embodiments, if the zipper is not in its locked position before starting the cycle, the error indicator light may come on along with a light on the zipper locking mechanism. When the water tank level is too low to run a cycle the error light indicator will turn on and a light near the removable water tank will turn on. When the grey water tank level is too high the indicator light may turn on and the indicator light may turn on near the removable grey water tank. If the indicator light is on, it may indicate that the device will not start a new cycle. In some embodiments, a tablet disposed on the device can provide a variety of notifications as described herein.

Near the cycle selection interface of the device, there may include a timer notifying the user of how long until the cycle has been completed. This timer can be displayed in many different styles including but not limited to a row of indicators light which are all on when the cycle is started and individually turn off until the cycle comes to a stop and all the lights of the timer are off.

In some embodiments, the device can include a pull out storage space to hold various accessories that can be used with the device. A pull-out storage space can be built into the side of the device and can hold 2 hangers. The two hangers provided with the device may be made from a temperature resistant plastic which can withstand a minimum of 120 degrees Celsius. The hanger shapes may be made to accommodate the various articles which can be used with the device.

In some instances, the device may include a power cord management system built into the device, which may be referred to as the cord keeper. The cord keeper may use a retracting system that allows the power cord to be stored inside the device when not plugged in and in use. The power cord can be pulled out to a specific length and locked into place when needing to be plugged into a power source.

For support and mobility, the device may be equipped with a foot stand or a set of wheels. For instance, the device can include 4 locking wheels for mobility of the device. The wheels can rotate independently of each other allowing for the device to be easily turned. A handlebar can be placed on the top of the device on the same side as a foot stand or wheels to provide a place for the device to be gripped.

Figure 5:
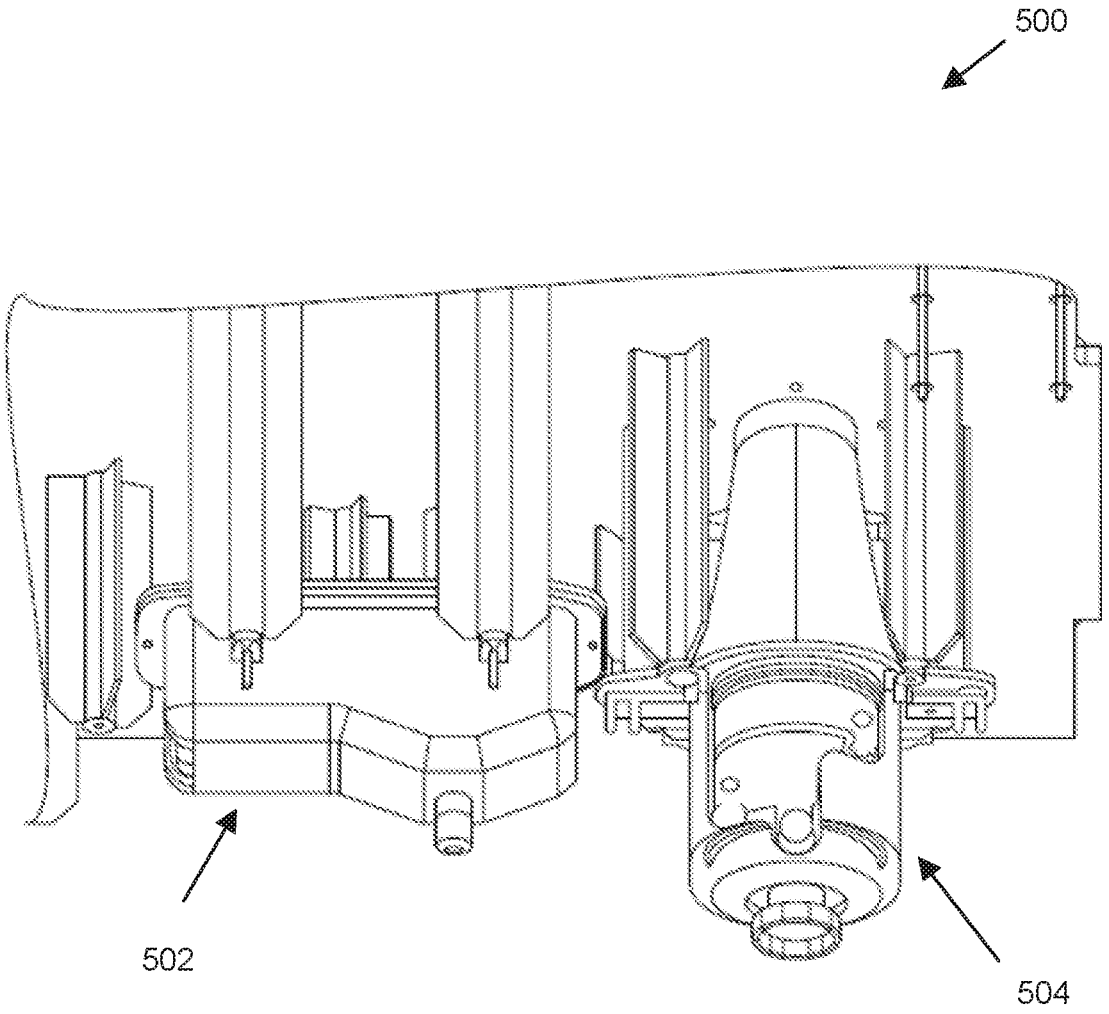
FIG. 5 is an illustration of an example secondary reservoir.

FIG. 5 is an illustration of an example secondary reservoir 502. In some embodiments, the device can include a secondary reservoir that can serve as an intermediary water tank between the primary tank and the water boiler. A water level sensor can be used inside the secondary reservoir to determine if it needs to be refilled. If the water level sensor detects the water in the secondary reservoir is low, it can activate the water pump 504 connected to the primary tank and fills the secondary reservoir. The secondary reservoir 502 can utilize gravity to feed water into the boiler. Water can also be fed directly into the boiler 504 from the primary water tank via a pump.

Figure 6:
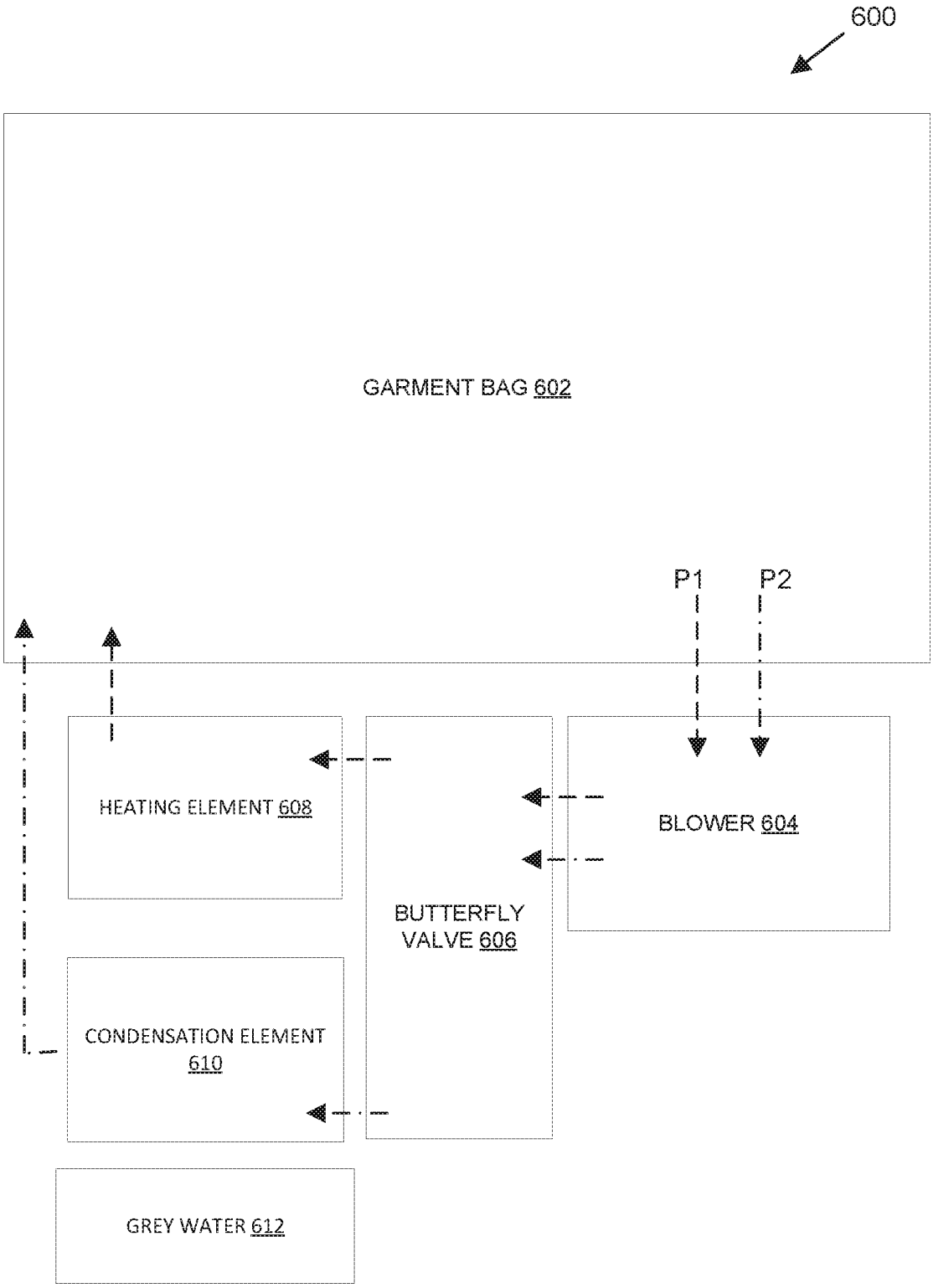
FIG. 6 is a flow diagram depicting air paths along the garment care device.

FIG. 6 is a flow diagram depicting air paths P1, P2 along the garment care device 600. As shown in FIG. 6, air may flow from a garment bag 602, through a series of components, and back to the garment bag 602 to complete a garment freshening process. The air paths P1, P2 may depict warm air and cool air, for example.

An air path can direct air from the garment bag 602 to a blower 604 capable of increasing the acceleration of the air flow. The air paths may go from the blower 604 to a butterfly valve 606 directing a first path P1 to a heating element 608 and a second path P2 to a condensation element 610. The condensation from condensation element 610 may be collected in grey water tank 612. The air flow may direct from the heating element 608 and the condensation element 610 back to a plenum of the garment bag 602.

Figure 7:
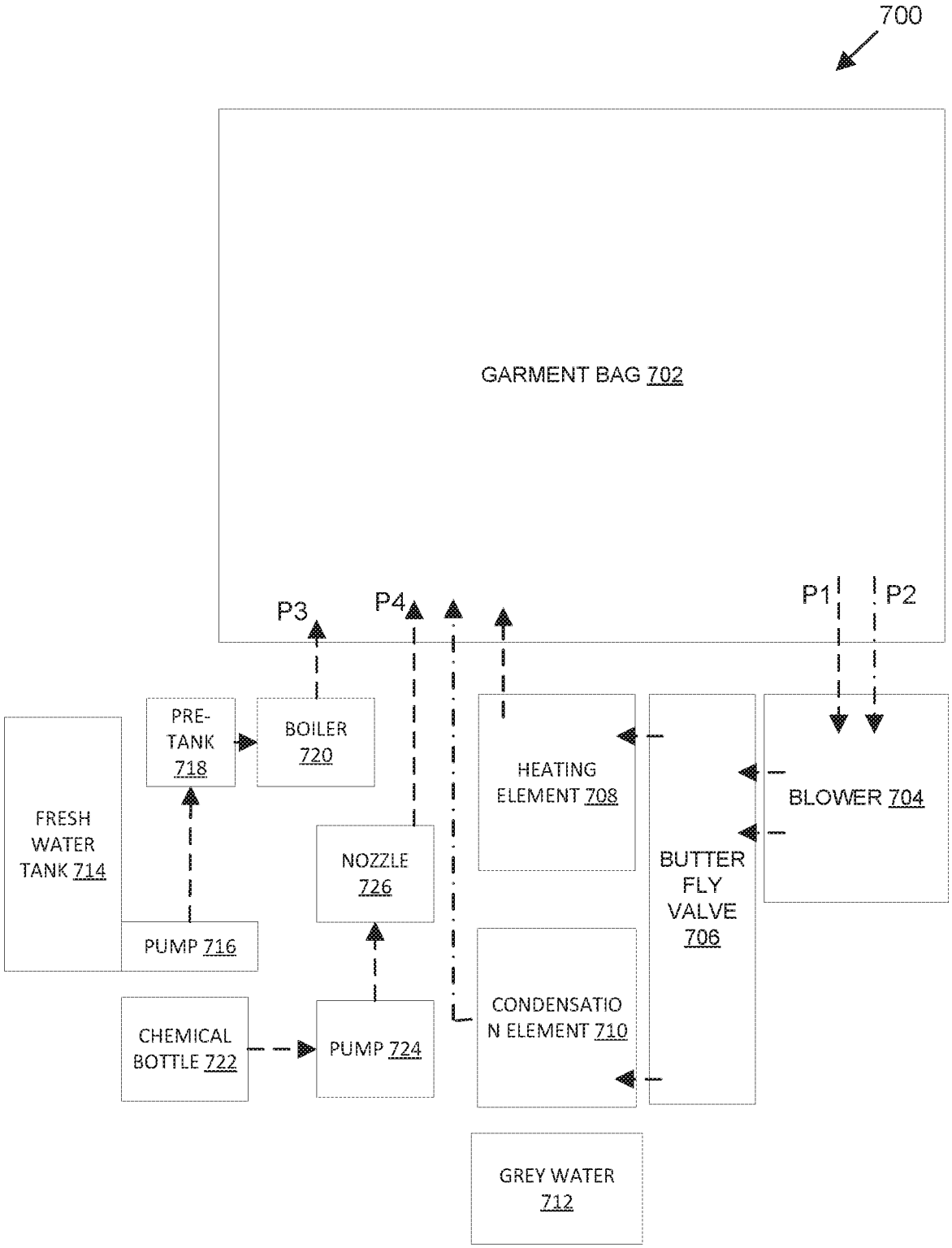
FIG. 7 is a block diagram depicting example air paths, a water path, and a chemical path for a garment freshening device.

FIG. 7 is a block diagram depicting example air paths, a water path, and a chemical path for a garment freshening device 700. The air paths P1, P2 can flow similarly as the paths P1, P2 identified in FIG. 6. A water path P3 can identify a flow of water from a fresh water tank 714 to a pump 716. The water can pump to a pre-tank 718 to a boiler 720 capable of heating the water and providing steam to the garment bag 702.

A chemical path P4 can originate from a chemical bottle 722 to a pump 724 and directed to a nozzle 726 capable of misting the chemicals in the garment bag 702.

Figure 8:
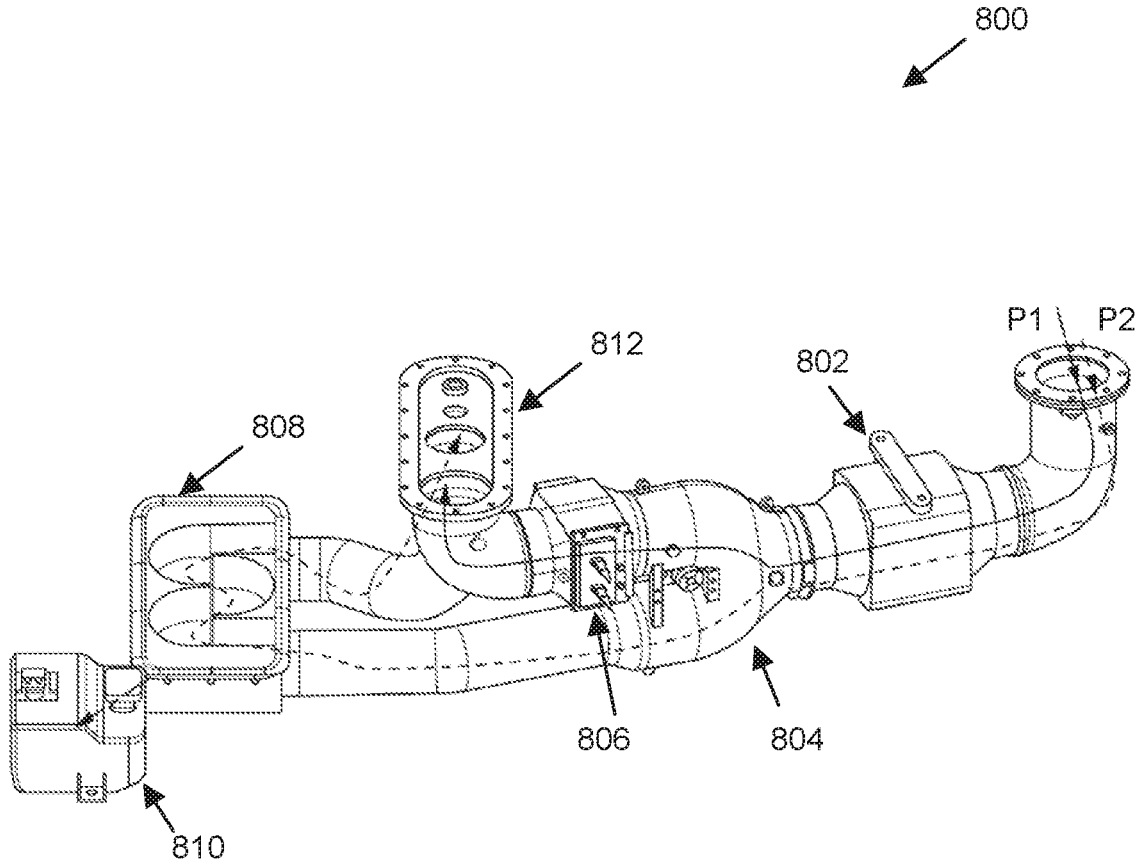
FIG. 8 is an illustration of an example tubing for air paths.

FIG. 8 is an illustration of an example tubing for air paths 800. The condenser may include a series of tubes carrying various air paths. For instance, a first path can direct an air path for pre-heat and drying, while a second path is a steam path for a condenser (e.g., steam circulation and condensing).

An air path can direct air from the garment bag to a blower 802 capable of increasing the acceleration of the air flow. The air paths may go from the blower 802 to a butterfly valve 804 directing a first path P1 to a heating element 806 and a second path P2 to a condensation element 808. The condensation from condensation element 808 may be collected in grey water tank 810. The air flow may direct from the heating element 806 and the condensation element 808 back to a plenum 812 of the garment bag.

In some embodiments, the garment care device may include a water release mechanism (e.g., a peristaltic pump) that can release water from the device. The garment care device may also include a chemical solution pump that may facilitate the flow of a chemical solution in the device. The device may include an air heater configured to heat air inside the garment bag. The device may include a servo motor, a boiler to boil water, and an air blower.

In some embodiments, water used to produce steam may be stored in a removable leakproof water tank situated in an accessible area on the front of the device. A removable and refillable water bottle with a cap may be used as the removable water tank as well. Refilling the water tank can be done by removing the water tank from the device, removing the waterproof seal, and filling it with clean potable water. A guiding fill line may be present inside the water tank to prevent overfilling.

Another option in place of the water tank is an attachment which allows a connection to a ¾ inch water line, for example. By using the waterline, users may no longer have to refill the water tank when empty, allowing for continuous cycles to be run. When the tank is inserted into the device, it may include a sealed system that allows for the product to be turned onto its side and prevent water leakage. This may be done by using a gasket seal around the water outlet where the water flows through. The seal may remain closed until opened by starting a cycle. The water tank may be a gravity-fed system that is controlled by a water release mechanism (e.g., pump, valve). When a cycle is started, the electronic solenoid valve may be activated, and it can allow the water tank outlet allowing water to flow through. The electronic solenoid valve may be replaced with a water pump which meters the water necessary for the cycle selected. Each cycle can use 0.25 to 1.5 cups of water depending on the cycle chosen, for example.

In some embodiments, the grey water collection tank may be a removable tank connected to a condenser that can be of various shapes and sizes but serves the purpose of collecting by-products from the steam clean and dry phases. Residual steam from the steam cycle and particles from the dry cycle may be collected through the intake plenum by the blower in the dry cycle and either collected in the grey water collection tank or released as steam through the venting. A vent may be situated on the side surface of the device. This vent may be used to optionally exhaust the steam out of the system to decrease the cycle time and prevent a majority of the steam from condensing on the interior of the garment bag. The grey water tank can connect to a condenser.

In some embodiments, the air path may start with the blower which circulates air through the enclosure of the garment bag. The 12-volt DC blower used may include an airflow range of 120 to 220 CFM, for example. The air may move from the blower through the air path into a Y-splitter which is used to control the path of air. The first path of the splitter valve may create a closed-loop system in which the steam/air already inside the bag is removed, passed through a heating element, and then back into the bag.

In some embodiments, the second path of the splitter takes steam and moves it through the condensation system. After the condensation system, the steam/air can be pushed back into the bag. The two paths can be looked at as a "heated path" and a "cooled path." The heated path can include a path where air is circulated over the air heater to be heated. The cooled path can include a path where steam is circulated through the condensation system to be cooled and condensed.

In some embodiments, the second path of the splitter valve may create an open-loop system in which the steam/air already inside the bag is removed then exhausted outside the device. The direction of the splitter path may be controlled by a servo motor which actuates a butterfly valve. The direction of the butterfly valve position may be determined by the phase of the cycle. The butterfly valve may create a closed-loop path during the steam cleaning cycle and open-loop path during the drying cycle. The two plenums that attach from the steam and air paths to the garment bag may have surface features that direct the steam and air towards the center of the bag where the articles are hanging.

In some embodiments, the electrical system may include two printed circuit boards; a power board and an interface board. The interface board may hold all connections to the interface on the top of the device including the cycle selection, light indicators, and cycle timer. Connected to the power board are an air blower, air heating element, boiler, water pump, chemical pump, and servo motor. The interface board and/or power board can be in electrical communication with a magnetic safety puck as described herein.

In some embodiments, the device may use AC power and internally converts at least a portion of the power to DC to provide power to the internal components using an internal power adaptor module. The air blower circulates air throughout the garment bag enclosed space and the air heater heats the ambient air. The boiler may be made from a water immersible heating element in a leakproof heat resistant enclosure used to boil the water (and, in some cases, the chemical solution). The water pump may be used to allow the flow of water from the water tank into the secondary mixing tank. The chemical pump may be used to meter the exact amount of chemical solution needed for a cycle into the misting system and/or a secondary mixing tank. The servo motor may be used to operate the butterfly valve for the splitter which controls the 2 air paths for the system. A PCB can be used to interface/engage with a safety puck as described herein.

There may be multiple phases that make up a cycle, such a preheat, steam clean, condensation, and dry phases, for example. Any combination of phases can be used during a cycle, for example, a cycle can be a steam clean and dry phase. A phase may be excluded from the full cycle and a single phase may also be used for a cycle if selected for example a cycle can be only the dry phase.

The preheat phase may be used to raise the internal temperature of the enclosed space of the garment bag to a temperature ranging from 50-90° C. or around 135° F., for example. This preheat phase may be used to prevent immediate condensation of the steam in the garment bag due to a large temperature difference between the steam and the interior space of the enclosure. An air heater may include a temperature sensor preventing the heating element itself from reaching a threshold temperature (e.g., 150° C.).

A steam phase can boil water and mist the chemical into the steam. A user can input the type of garment and fabric they are inserting, a level of wrinkle removal, and from that information, the system can provide a recommended cycle type. The system can include a few presets that the cycle can be picked from based on the clothing information. Based on the fabric and garment type, the system can control how much steam is entering the system, how hot the internal temperature will get during pre-heat and dry, the overall time of a preheating cycle or drying cycle, a steam time, etc. This temperature may be controlled by the heating element and blower, and the system can use the speed of the blower to control the temperature inside the bag, faster blower speed equates to lower temperatures. Alternatively, the system can cycle the heater on and off to lower the temperature.

In some embodiments, steam clean phase may introduce steam and/or chemicals into the garment bag through the plenums. The duration of the phases can be changed to meet the needs of the user. For instance, may be two baseline cycles installed; the first is with a 3-minute pre-heat, 4-minute steam, and 3-minute dry cycle; the second is with a 3-minute pre-heat, 8-minute steam, and 5-minute dry cycle. It is contemplated that any duration of each of the phases in the multi-step freshening cycle may be utilized to freshen garments in the garment bag.

The heating element for the boiler may be 120 volts and may range from 1000 to 1500 watts. The steam may bring the internal temperature of the garment bag enclosure to a temperature ranging from 70 to 100° C. The steam cycle may be used to kill bacteria and remove odors and wrinkles from the articles meant to be freshened.

The dry phase may be used to dry the excess moisture from the steam clean phase out of the bag. During the pre-heat and dry cycles, the air heater and the blower are turned on. The air heater is situated after the blower in the air path. Because the air heater raises the temperature of the ambient air by situating it in front of the blower, air flowing from the blower into the garment bag may be heated to a temperature of 50° C. to 90° C. The electronic subsystem may include various sensors throughout the system. There may include water level sensors, accelerometers, safety lock sensors, and temperature sensors. The device can use Bluetooth Low Energy (BLE), WiFi, or cellular connection to transfer data. This may be done by using a BLE, WiFi, a cellular 5G module, etc. These forms of communication may also be used as a means to remotely control the device. Users may be able to connect to the device using BLE with a BLE enabled mobile device or using WiFi via a local router. In some instances, the user, via a user-specific mobile device, can interact with a server associated with the device to control various features of the device as described herein.

Figure 9:
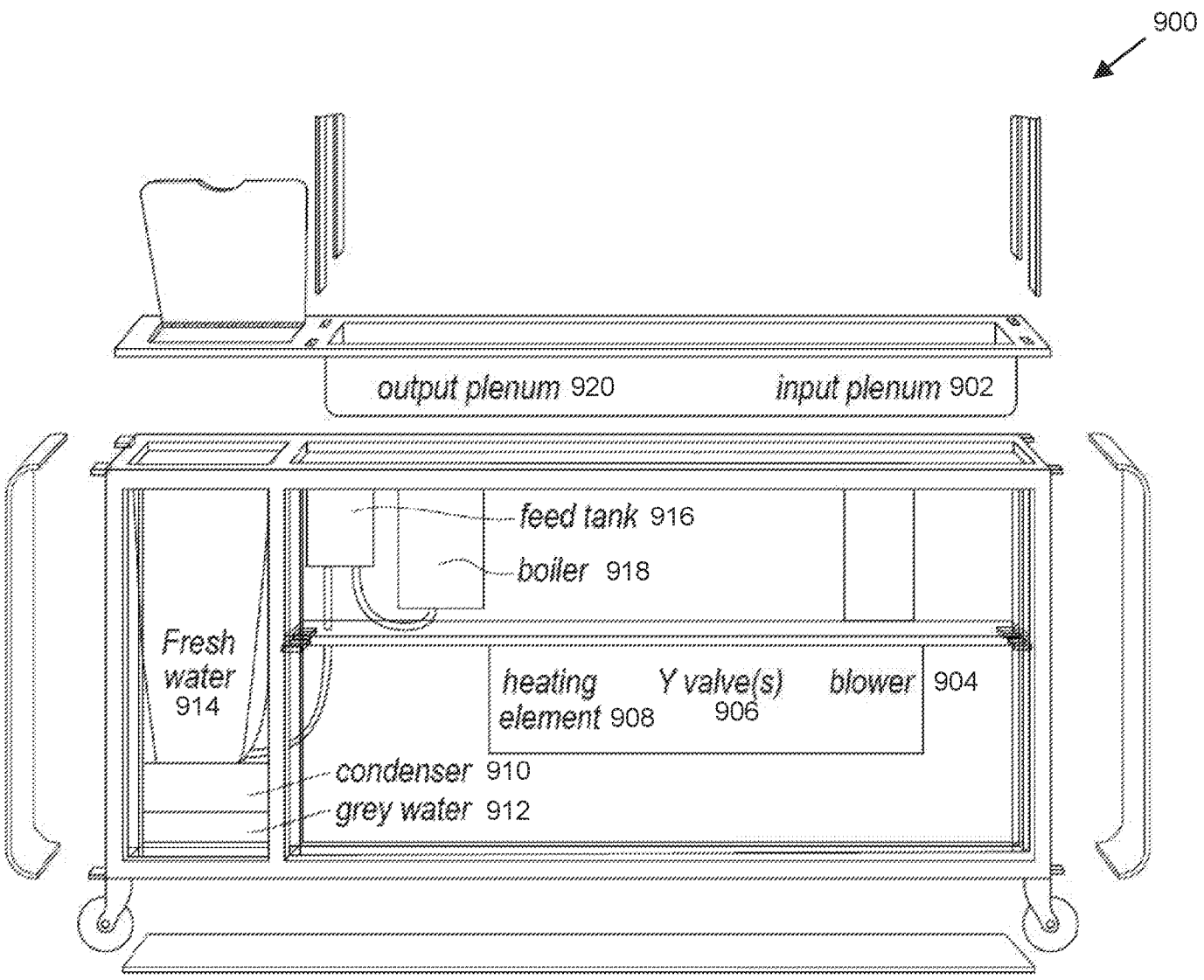
FIG. 9 is an illustration of components disposed in an example housing.

FIG. 9 is an illustration of components disposed in an example housing 900. The housing can include multiple plenums 902, 920 allowing for air/steam/chemicals to enter/exit the garment bag. An input plenum 902 can obtain air from the garment bag and flow the air to a blower 904. The blower 904 can direct air to a valve 906 (e.g., butterfly valve, Y valve) that moves air to a heating element 908 and back to the garment bag via output plenum.

Water may be stored in a water tank 910, condensed via condenser 912 with condensation stored in grey water tank 914. Water may flow from tank 910 to feed tank 916 and to boiler 918 that can boil that water and allow for steam to enter garment bag via output plenum 920.

Figure 10:
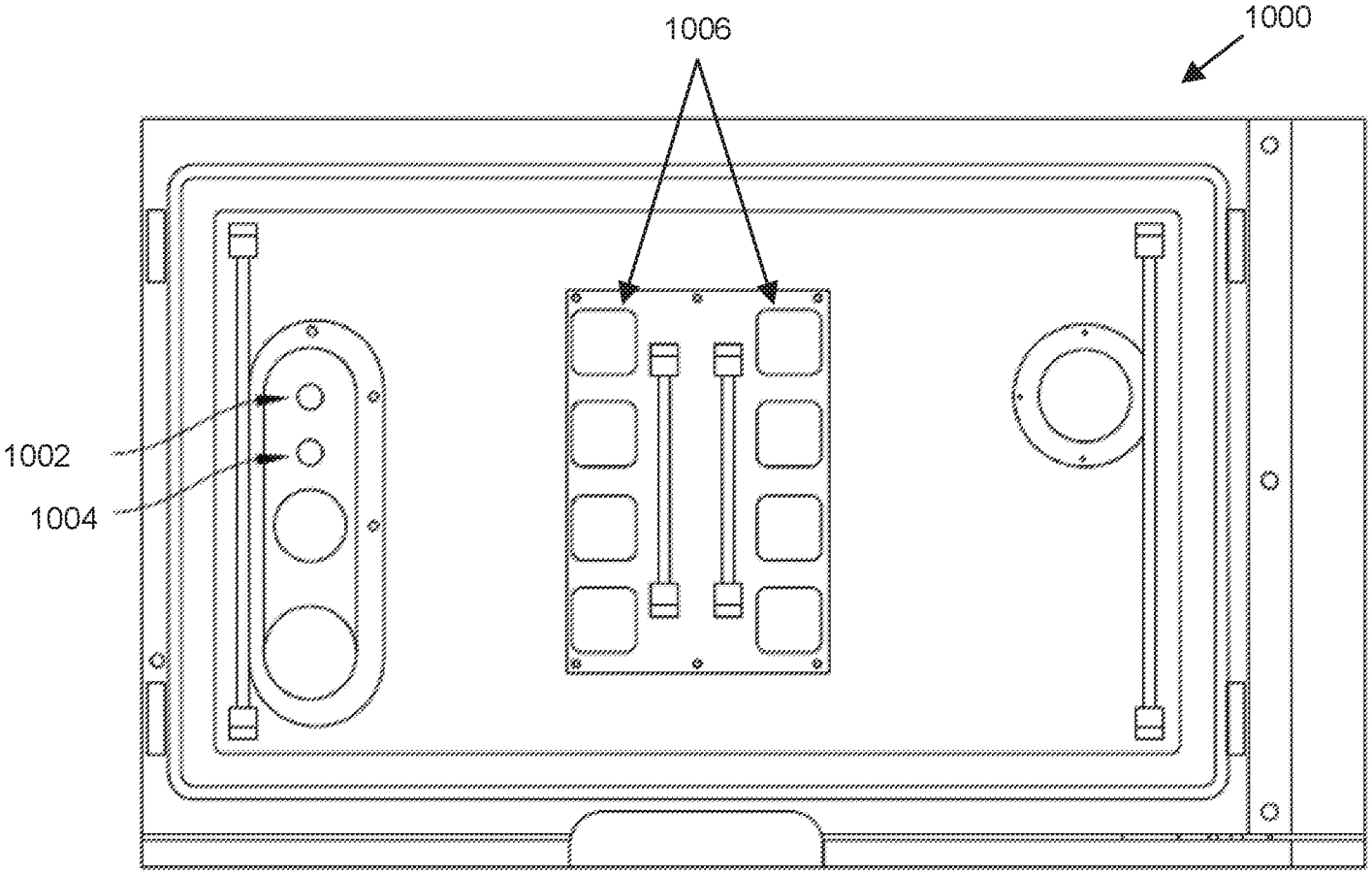
FIG. 10 illustrates an example housing including a tensioner apparatus.

FIG. 10 illustrates an example housing including a tensioning apparatus 1000. The tensioner 1000 can be disposed inside the garment bag and on the housing. The tensioner can engage with a garment to apply a force to the garment to add tension to the garment that can increase efficacy of cleaning the garment. Particularly, the tensioner 1000 can include cables 1006 capable to connecting to the garment via garment clips. In some embodiments, FIG. 10 can also illustrate a plenum for steam 1002 and a plenum for a chemical 1004.

Figure 11:
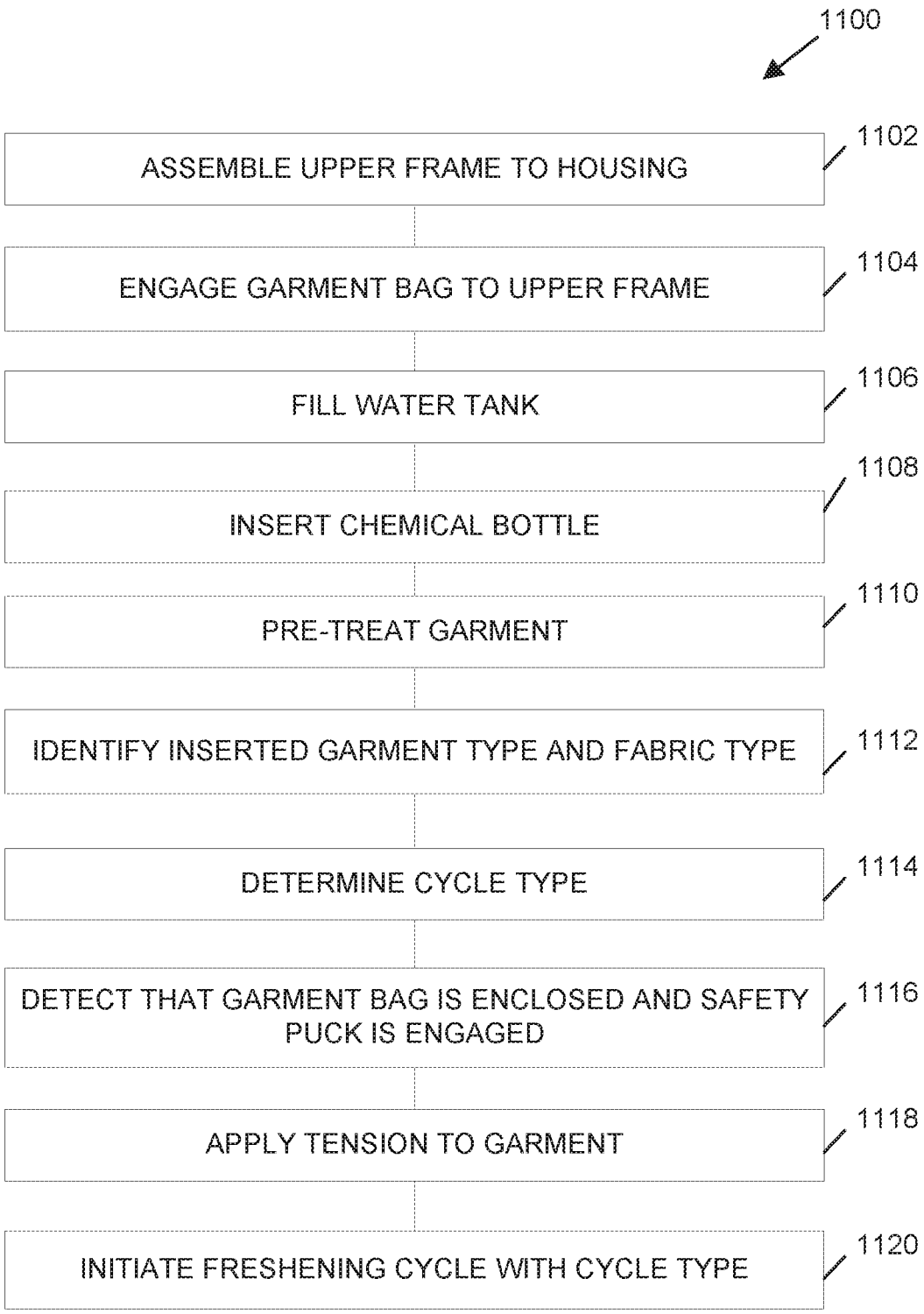
FIG. 11 is a flow process of an example method to initiate a freshening cycle.
Figure 12:
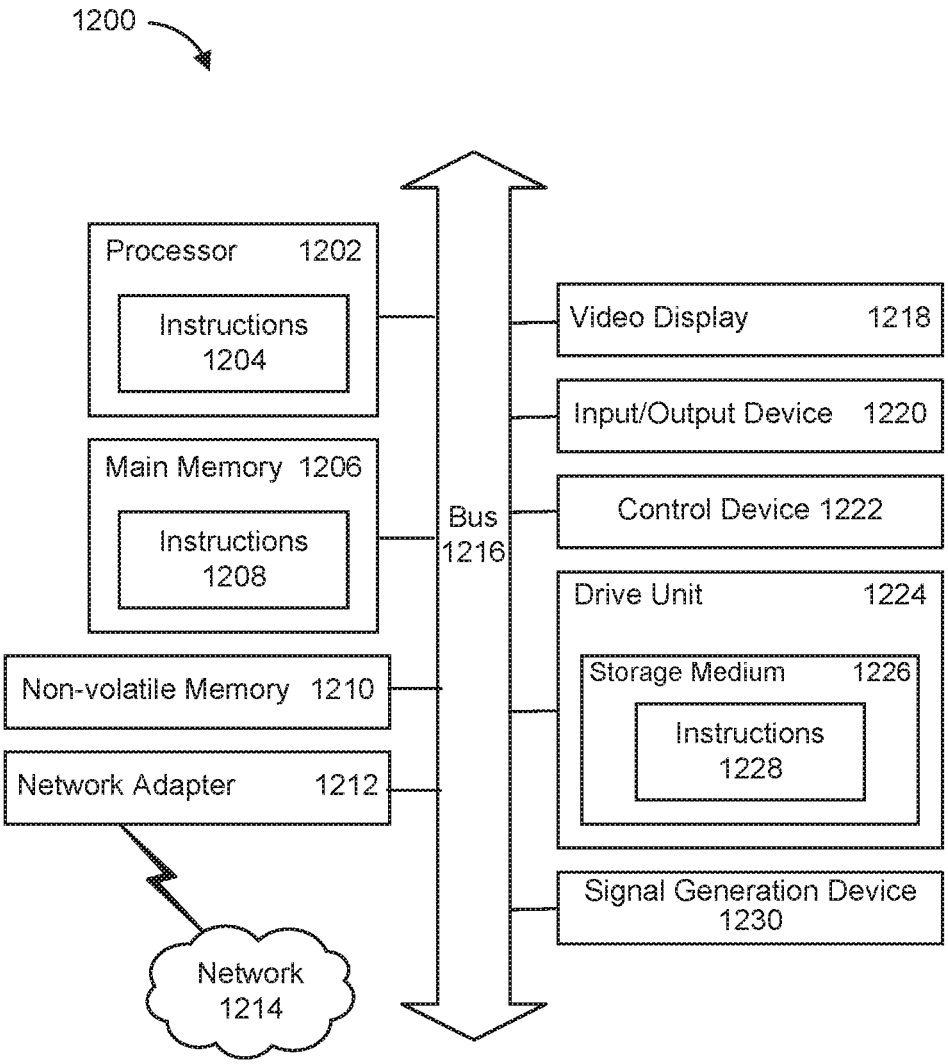
FIG. 12 is a block diagram that illustrates an example of a processing system in which at least some operations described herein can be implemented.

FIG. 11 is a flow process 1100 of an example method to initiate a freshening cycle. The method can include assembling an upper frame to a housing (block 1102). The upper frame can be removably engaged to the housing, where the upper frame can include a series of metallic frame pieces capable to framing a garment bag.

The method can include engaging a garment bag to the upper frame (block 1104). The garment bag can be disposed above the upper frame and attached to the housing around the upper frame to allow for a secure engagement to the housing.

The method can include filling a water tank (block 1106). Water in the water tank can be turned into steam that can fill the garment bag.

The method can include inserting a chemical bottle to the housing (block 1108). The chemical bottle can include any suitable dispenser capable of disposing a chemical into the housing. The chemical bottle can be inserted into a chemical insertion area of the housing.

The method can include pre-treating the garment (block 1110). This can include performing any of a series of pretreating actions, such as adding a chemical to the garment, performing a touch up action, etc. In some instances, this can include misting a chemical onto the garment to enhance freshening of the garment.

The method can include identifying an inserted garment type, fabric type, and/or a wrinkle level (block 1112). The type of garment (e.g., a shirt, dress, cotton blazer) can be identified either by the user via an interface or automatically using sensors disposed in the device, for example.

The method can include determining a cycle type (block 1114). The cycle type can be based on a garment type, a fabric type, a severity/number of wrinkles included on the garment, a duration to freshen the garment, an amount of stains on the garment, etc. In some instances, the system can automatically detect a cycle type may matching a garment type to a recommended cycle type.

The method can include detecting that the garment bag is enclosed and that a safety puck is engaged (block 1116). The garment bag may be enclosed when a fastener (e.g., a zipper) encloses the garment bag. The safety puck can engage to a zipper and be engaged with an interface to ensure an enclosed garment bag. If the safety puck is disengaged from the interface, the garment bag may be opened and the system can stop the freshening cycle.

The method can include applying tension to the garment (block 1118). This can include engaging extendable cords to the garment to apply tension to the garment. This can improve the garment's exposure to steam/air/chemicals/etc., in the garment bag and can assist in reducing wrinkles, for example.

The method can include initiating a freshening cycle based on the determined cycle type (block 1120). The method can also include various loading, refilling, cleaning, unloading, and storing features as described herein.

In some embodiments, the device may utilize a collapsing mechanism that allows for the device to be collapsed and expanded in the vertical direction. The collapsing mechanism may include a hand-activated actuator, latch locking mechanism, guide rails, and a constant force spring. In some instances, the device may be collapsed reducing the volume enclosed by the garment bag when it is not in use. The garment bag may be capable of folding in on itself when the device is not in use and collapsed, which may prevent "overhang" of material when the device is collapsed. The garment bag may include two parts that allow it to fold in on itself. One may include the detachable points of contact maintained from the garment bag to the body of the device, these specific points of contact translate into the folding points of the garment bag when the device is collapsed. The garment bag also may use a more rigid material such as, for example, polyester boning, embedded inside it to provide structural integrity when the device is in use and when collapsed.

In some embodiments, the device can include a latch. The latch can lock into two positions, one is the fully upright expanded position and the second is the closed collapsed position. The garment can be in the fully upright expanded position for a cycle to be started. Bearings may be used on the two rails to provide smooth sliding. The device may utilize a manual expanding and collapsing system assisted with a constant force spring. The constant force spring may allow for the collapsing mechanism to be in a state of balance. A state of balance may allow for both the raising and lowering of the device to be done with the same amount of minimal force. This may be possible because the upward force from the constant force spring is balanced by the downward force from the weight of the lid and attached garment bag allowing for a balanced collapsing and expanding system.

In some embodiments, the constant force spring, rails, and latching mechanism may be mounted within a cavity in the housing of the device, by integrating the collapsing system into the body to minimize a width for the device. The actuator for the latching mechanism may be in an accessible position on the device for a user. The mechanism may be placed near the horizontally central position of the device. This may allow for an even distribution of force over the device when collapsing and expanding. The collapsed position may allow for the overall height of the device to be reduced. This may reduce the overall volume of the device by reducing the volume of space enclosed by the garment bag, the volume of the body of the device remains the same. By reducing the overall volume of the device less space is needed by the machine and it may be able to be stored in spaces where the full height would not.

In some embodiments, the system can include a magnetic zipper safety mechanism for a garment care device. The zipper may use a magnetic sensing mechanism which may include an auto shut-off feature that activates when the zipper is opened. The magnetic lock may include a magnet that the end of the zipper attaches to when in the fully closed position. The magnetic zipper connection can also be replaced with a zipper pin locking mechanism similar to that in suitcase zippers. When the lock is broken, and the zipper is opened, the entire system may shut-off no matter which phase of the cycle is turned on.

In some embodiments, the user can roll the device to an operating space where it can be used. The user may then plug the retractable power cord into a 120-volt power source and use the actuator to release the lock on the sliding mechanism and lift the lid of the device into its fully expanded state where it will lock into place. The user may then remove the provided hangers from the hanger storage area and hang the intended articles on them. The user may unzip the zipper on the front of the garment bag and hang the hanger with the article onto the crossbar situated on the top of the interior of the garment bag.

In some embodiments, to ensure the device is ready to be used the user may lock the zipper into its fully closed state, remove and fill the water tank, insert the bottle of chemical solution and empty the grey water tank. To start the cycle the user may use the interface to select which cycle they intend to run and push the cycle start button. There may be 4 cycles to choose from with 3 being preset cycles and 1 being a customizable cycle. If all errors are cleared the cycle may start automatically.

In some embodiments, when the cycle starts the blower and the air heater may turn on circulating heated air through the garment bag. Then, a solenoid valve may open allowing the water from the water tank to flow into the secondary mixing chamber. Then the chemical pump may meter the chemical into the secondary mixing chamber. From there the mixture may flow into the boiler. The heating element in the boiler may then turn on heating the mixture and turning it in a steam form. The steam may flow from the boiler through the plenum into the garment bag. The plenums have surface details which direct the flow of air and steam towards the center of the bag where the articles hang. The steam may fill the garment bag and then the blower may turn on circulating the steam or turn on to condense steam during the cycle.

In some embodiments, once the steam is complete the condense phase can continue until the steam is condensed to water, and the dry phase can start. Once the steam clean phase is complete the blower and the air heater may both turn on and circulate heated air throughout the bag. The saturated air from the garment bag may flow through the secondary air path and condensation may be collected in the grey water tank and the air may be expelled through the vent leading to the exterior of the system. Once the cycle is complete an indicator may flash, and a sound may be expelled from the device notifying the user. The user may now unlock the zipper, unzip the garment bag, and remove the articles on the hangers from the crossbar. Once the articles are removed the garment bag may be zipped and the device can be collapsed and stowed away or tilted on its back surface and stowed. Users can be notified via interface and wireless communication (text/email/app notification) that the cycle is complete. The user may confirm their identity to remove their garments from the device.

In some embodiments, the device may track a type of garment and a number of garments inserted into the device by each user. In a first embodiment, the user may manually provide input as to how many garments are inserted into the device and/or what kind of garments are inserted into the device. This manual input may be provided into a application of a client device and/or the user interface included in the device. Users may be able to select what fabric the garment is along with what type of garment is being inserted into the device. For example, from the user interface or external input (mobile device), the user could input that the garment is a red cotton t-shirt.

In a second embodiment, the device may include a computer vision module that can identify a number and type of garments inserted into the garment bag. The computer vision module may include one or more imaging devices (e.g., cameras) included interior and/or exterior of the garment bag. The imaging device(s) may capture images of garments of clothing as they are inserted in the garment bag. The computer vision module may utilize any of machine learning, neural networks, artificial intelligence, etc., in identifying garments inserted into the garment bag by each user.

An algorithm/database may be used to determine what type of garment is being inserted, as the computer vision module may be able to differentiate between the shapes of pants, shirts, and dresses as an example. Among shirts, computer vision module may determine if it is long sleeved or short sleeved, what type of collar is on the shirt, and how many buttons are on the shirt if any, for example. This may help differentiate between a t-shirt, a button-down shirt, and a short sleeve polo for example. There may also be a fabric sensor on the device which uses a camera which can view the thread and weave patterns on a garment of clothing. Fabric thread and weave patterns can be used to differentiate between different material of the garments of clothing. The users may take their garment(s) and place it against the fabric sensor to allow for the camera to capture an image of the thread and weave pattern of the garment.

In some embodiments, computer vision and manual garment entry can be used in combination to gather a full set of data on the garment. For example, if the camera is only able to capture the type of garment inserted for example a t-shirt or pants, the user would be able to manually enter the color and fabric of the garment. If the fabric sensor was the only computer vision device used and the material of the garment was determined, then the user could manually enter in what type of garment was inserted. The data of the garment captured would be stored and can be used to have the invention automatically select the best cycle based on the fabric and also to build a "virtual closet" for the user. Users may be able to create unique identifications for each garment they insert, for example "red cotton t-shirt #1." This information could be saved to build a listing of garments associated with a user, or "virtual closet," and the user may be able to see the last time that specific garment was run through a cycle in the device. The user may also be able to see all garments of clothing that have been run through a cycle in the device, this will build their "virtual closet" so they may be able to see all of their clothes through a mobile application. This may allow users to know exactly what is in their closets and when something was last cleaned/refreshed. Because the device is made to be used on a daily basis, users may know when they last wore a specific garment of clothing.

Example Processing System

FIG. 13 is a block diagram illustrating an example of a processing system 1300 in which at least some operations described herein can be implemented. As shown in FIG. 13, the processing system 1300 may include one or more central processing units ("processors") 1302, main memory 1306, non-volatile memory 1310, network adapter 1312 (e.g., network interfaces), video display 1318, input/output devices 1320, control device 1322 (e.g., keyboard and pointing devices), drive unit 1324 including a storage medium 1326, and signal generation device 1330 that are communicatively connected to a bus 1316. The bus 1316 is illustrated as an abstraction that represents any one or more separate physical buses, point to point connections, or both connected by appropriate bridges, adapters, or controllers. The bus 1316, therefore, can include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

In various embodiments, the processing system 1300 operates as part of a user device, although the processing system 1300 may also be connected (e.g., wired or wirelessly) to the user device. In a networked deployment, the processing system 1300 may operate in the capacity of a server or a client machine in a client-server network environment, or as a peer machine in a peer-to-peer (or distributed) network environment.

The processing system 1300 may be a server computer, a client computer, a personal computer, a tablet, a laptop computer, a personal digital assistant (PDA), a cellular phone, a processor, a web appliance, a network router, switch or bridge, a console, a hand-held console, a gaming device, a music player, network-connected ("smart") televisions, television-connected devices, or any portable device or machine capable of executing a set of instructions (sequential or otherwise) that specify actions to be taken by the processing system 1300.

While the main memory 1306, non-volatile memory 1310, and storage medium 1326 (also called a "machine-readable medium) are shown to be a single medium, the term "machine-readable medium" and "storage medium" should be taken to include a single medium or multiple media (e.g., a centralized or distributed database, and/or associated caches and servers) that store one or more sets of instructions 1328. The term "machine-readable medium" and "storage medium" shall also be taken to include any medium that is capable of storing, encoding, or carrying a set of instructions for execution by the computing system and that cause the computing system to perform any one or more of the methodologies of the presently disclosed embodiments.

In general, the routines executed to implement the embodiments of the disclosure, may be implemented as part of an operating system or a specific application, component, program, object, module or sequence of instructions referred to as "computer programs." The computer programs typically comprise one or more instructions (e.g., instructions 1304, 1308, 1328) set at various times in various memory and storage devices in a computer, and that, when read and executed by one or more processing units or processors 1302, cause the processing system 1300 to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution. For example, the technology described herein could be implemented using virtual machines or cloud computing services.

Further examples of machine-readable storage media, machine-readable media, or computer-readable (storage) media include, but are not limited to, recordable type media such as volatile and non-volatile memory devices 1310, floppy and other removable disks, hard disk drives, optical disks (e.g., Compact Disk Read-Only Memory (CD ROMS), Digital Versatile Disks (DVDs)), and transmission type media, such as digital and analog communication links.

The network adapter 1312 enables the processing system 1300 to mediate data in a network 1314 with an entity that is external to the processing system 1300 through any known and/or convenient communications protocol supported by the processing system 1300 and the external entity. The network adapter 1312 can include one or more of a network adaptor card, a wireless network interface card, a router, an access point, a wireless router, a switch, a multilayer switch, a protocol converter, a gateway, a bridge, bridge router, a hub, a digital media receiver, and/or a repeater.

The network adapter 1312 can include a firewall which can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall may additionally manage and/or have access to an access control list which details permissions including for example, the access and operation rights of an object by an individual, a machine, and/or an application, and the circumstances under which the permission rights stand.

As indicated above, the techniques introduced here implemented by, for example, programmable circuitry (e.g., one or more microprocessors), programmed with software and/or firmware, entirely in special-purpose hardwired (i.e., non-programmable) circuitry, or in a combination or such forms. Special-purpose circuitry can be in the form of, for example, one or more application-specific integrated circuits (ASICs), programmable logic devices (PLDs), field-programmable gate arrays (FPGAs), etc.

From the foregoing, it will be appreciated that specific embodiments of the device have been described herein for purposes of illustration, but that various modifications may be made without deviating from the scope of the device. Accordingly, the device is not limited except as by the appended claims.

What is claimed is:

1. A garment care device comprising:

a housing including:

a tank capable of holding an amount of water;

a boiler configured to heat a portion of the amount of water into steam in a first air flow;

a chemical reservoir configured to disperse a chemical into the first air flow;

a blower configured to direct air along a second air flow; and a frame assembly removably engaged to the housing;

a garment bag disposed around the frame assembly and removably engaged to the housing, wherein the garment bag is configured to receive and enclose a garment, and wherein the garment bag is configured to receive the air along the second air flow and the steam and the dispersed chemical in the first air flow via a plenum between the housing and garment bag;

a processing unit configured to control components of the garment care device and initiate a freshening cycle; and a magnetic device including:

an outer surface engaged to a fastener allowing for opening and secure closure of the garment bag; and an inner surface including a magnet configured to magnetically engage with a magnetic portion of an interface, wherein the processing unit is configured to: initiate the freshening cycle responsive to detecting the magnetic engagement of the magnetic portion of an interface and the magnet, and stop the freshening cycle responsive to detecting disengagement of the magnetic portion of an interface from the magnet.

2. The garment care device of claim 1, further comprising:

a front plate removably engaged to the housing, wherein the front plate is configured to be replaced by another front plate type to be removably engaged to the housing.

3. The garment care device of claim 1, further comprising:

a chemical entry area disposed adjacent to the tank and configured to receive the chemical from the chemical reservoir.

4. The garment care device of claim 1, wherein the processing unit is further configured to:

detect a garment type and/or a fabric type of the garment disposed in the garment bag; and identify a recommended freshening cycle type based on the garment type and fabric type, wherein the initiated freshening cycle includes the recommended freshening cycle type.

5. The garment care device of claim 1, further comprising:

a secondary reservoir disposed between the tank and boiler, wherein the secondary reservoir feeds water into the boiler responsive to the processing unit detecting that a boiler sensor indicates that a water level in the boiler is below a threshold level.

6. The garment care device of claim 1, wherein the processing unit is further configured to:

obtain information indicative of a severity of wrinkles on the garment; and modify features of the freshening cycle based on the information indicative of the severity of wrinkles on the garment.

7. The garment care device of claim 1, further comprising:

a tensioner apparatus including set of extendable tension cables and a set of clips configured to engage to the garment and provide tension to the garment disposed in the garment bag.

8. The garment care device of claim 1, wherein the processing unit is further configured to:

receive identification information via a touchscreen disposed on the garment care device;

process the identification information to verify an identity of a client; and responsive to verifying the identity of the client, unlocking a locking mechanism disposed on the garment bag to allow for retrieval of the garment from the garment bag.

9. An apparatus to freshen a garment, the apparatus comprising:

a housing;

a garment enclosure removably engaged to the housing, wherein the garment bag is configured to receive and enclose a garment, and wherein the garment bag is configured to receive air along a first air flow from the housing and a mixture of steam and a chemical in a second air flow from the housing;

a magnetic device configured to engage to a fastener allowing for opening and secure closure of the garment bag and magnetically engage to an interface; and a processing unit configured to control components of the garment care device and initiate a freshening cycle responsive to determining that the safety magnetic device is magnetically engaged to the interface.

10. The apparatus of claim 9, wherein the housing further including:

a tank capable of holding an amount of water;

a boiler configured to heat a portion of the amount of water into steam in the first air flow;

a chemical nozzle configured to disperse the chemical into the first air flow;

a blower configured to direct air along the second air flow; and a condenser cooling heated air into condensed air, wherein any condensation is collected in a grey water tank.

11. The apparatus of claim 9, wherein the freshening process includes any of: a heating process, a steam process, a condensation process, and a dry process.

12. The apparatus of claim 9, wherein the processing unit is further configured to:

detect a garment type and fabric type of the garment disposed in the garment bag; and identify a recommended freshening cycle type based on the garment type and fabric type, wherein the initiated freshening cycle includes the recommended freshening cycle type.

13. The apparatus of claim 9, further comprising:

a secondary reservoir disposed between the tank and boiler, wherein the secondary reservoir feeds water into the boiler responsive to the processing unit detecting that a boiler sensor indicates that a water level in the boiler is below a threshold level.

14. The apparatus of claim 9, further comprising:

a tensioner apparatus including set of extendable tension cables and a set of clips configured to engage to the garment and provide tension to the garment disposed in the garment bag.

15. The apparatus of claim 9, wherein the processing unit is further configured to:

receive identification information via a touchscreen disposed on the garment care device;

process the identification information to verify an identity of a client; and responsive to verifying the identity of the client, unlocking a locking mechanism disposed on the garment bag to allow for retrieval of the garment from the garment bag.

* * * * *